US011389016B1

(12) United States Patent
Strassburg

(10) Patent No.: US 11,389,016 B1
(45) Date of Patent: Jul. 19, 2022

(54) STORAGE DEVICE FOR SEWING MACHINE PRESSER FEET

(71) Applicant: Michelle Lori Strassburg, Chesterfield Township, MI (US)

(72) Inventor: Michelle Lori Strassburg, Chesterfield Township, MI (US)

( * ) Notice: Subject to any disclaimer, the term of this patent is extended or adjusted under 35 U.S.C. 154(b) by 385 days.

(21) Appl. No.: 16/593,772

(22) Filed: Oct. 4, 2019

(51) Int. Cl.

| | |
|---|---|
| ***A47F 5/02*** | (2006.01) |
| ***A47B 81/00*** | (2006.01) |
| ***A47F 5/04*** | (2006.01) |
| ***A47F 5/00*** | (2006.01) |
| *D05B 29/06* | (2006.01) |

(52) U.S. Cl.
CPC ..... *A47F 5/02* (2013.01); *A47B 81/00* (2013.01); *A47F 5/0006* (2013.01); *A47F 5/04* (2013.01); *D05B 29/06* (2013.01)

(58) Field of Classification Search
CPC .... A47F 5/02; A47F 7/021; A47F 5/04; A47F 7/08; A47F 7/02; A47F 5/05; A47F 7/022; A47F 5/0087; A47F 3/10; A47F 5/0823; A47F 5/0006; A47F 5/0807; A47F 5/0876; A47F 5/0884; D05B 29/06; D05B 81/00; A47B 81/00
See application file for complete search history.

(56) References Cited

U.S. PATENT DOCUMENTS 4,534,471 A * 8/1985 Zahn ..... B43M 99/008 211/163
6,036,311 A * 3/2000 Friedman ..... A47F 5/02 351/158
6,119,871 A * 9/2000 Mengel ..... A47F 7/08 211/117
6,443,317 B1 * 9/2002 Brozak, Jr. ..... A47F 7/021 211/85.1
6,505,749 B1 * 1/2003 Panetta ..... A47B 96/025 211/163
D609,080 S * 2/2010 Schorn ..... D6/552
9,521,902 B2 * 12/2016 Villalobos ..... A47B 49/008
2006/0081548 A1 * 4/2006 Babbino ..... A47F 7/021 211/85.1
2006/0226321 A1 * 10/2006 Tracy ..... A63B 60/60 211/85.7
2009/0127138 A1 * 5/2009 Allameh ..... A47F 7/02 206/6.1
2014/0061401 A1 * 3/2014 Bernstein ..... A47F 5/0006 248/125.3
2015/0305497 A1 * 10/2015 Dolan ..... A47F 5/0884 211/70.7

(Continued)

*Primary Examiner* — Hiwot E Tefera

(74) *Attorney, Agent, or Firm* — Buckert Patent & Trademark Law Firm PC; John F. Buckert

(57) ABSTRACT

A storage device for sewing machine presser feet is provided. The storage device includes a base member and a tower member rotatably coupled to the base member. The tower member is centered about a longitudinal axis and extends along the longitudinal axis. The tower member has an outer side surface with a first plurality of hangers disposed thereon. The first plurality of hangers include a first hanger. The first hanger has first and second extension arms and a tab member configured to hold a sewing machine presser feet thereon. The tab member of the first hanger is disposed between and above the first and second extension arms of the first hanger.

20 Claims, 14 Drawing Sheets

(56) References Cited

U.S. PATENT DOCUMENTS

| | | | | |
|---|---|---|---|---|
| 2016/0135616 | A1* | 5/2016 | Fisher | A47F 5/0006 211/13.1 |
| 2018/0146804 | A1* | 5/2018 | Travisono | F16B 2/22 |
| 2020/0329889 | A1* | 10/2020 | Wen | F16B 2/22 |

* cited by examiner

STORAGE DEVICE FOR SEWING MACHINE PRESSER FEET

BACKGROUND

A box has been utilized for storing sewing machine presser feet therein. A disadvantage with the box is that a lid of the box must be opened to access the sewing machine presser feet stored inside.

The inventor herein has recognized a need for an improved storage device for sewing machine presser feet that eliminates the above identified disadvantage.

SUMMARY

A storage device for sewing machine presser feet in accordance with an exemplary embodiment is provided. The storage device includes a base member and a tower member rotatably coupled to the base member. The tower member is centered about a longitudinal axis and extends along the longitudinal axis. The tower member has an outer side surface with a first plurality of hangers disposed thereon. The first plurality of hangers include a first hanger. The first hanger has first and second extension arms and a tab member. The tab member of the first hanger is disposed between and above the first and second extension arms of the first hanger.

DETAILED DESCRIPTION

Figure 1:
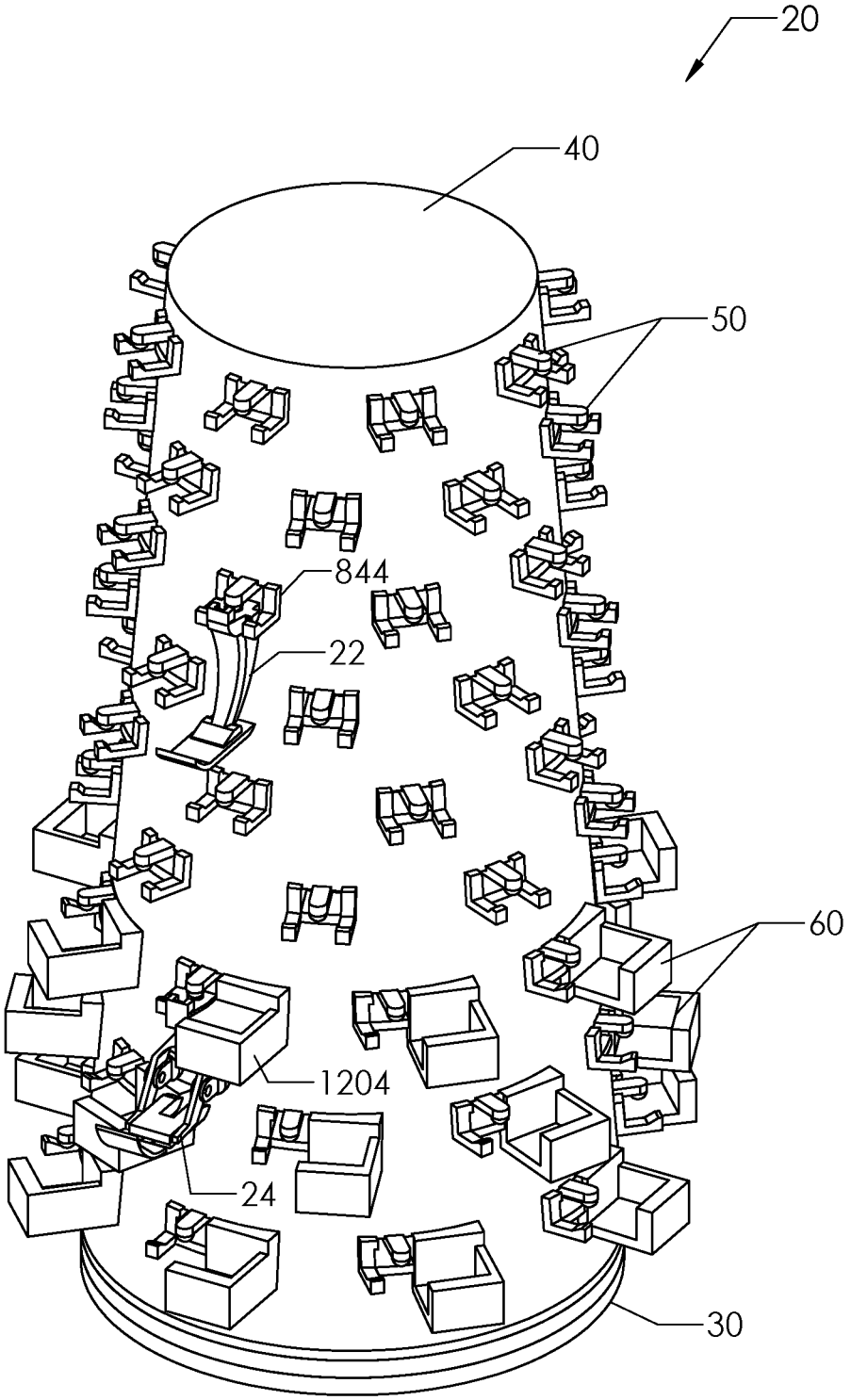
FIG. 1 is a schematic of a storage device holding first and second sewing machine presser feet thereon in accordance with an exemplary embodiment.
Figure 2:
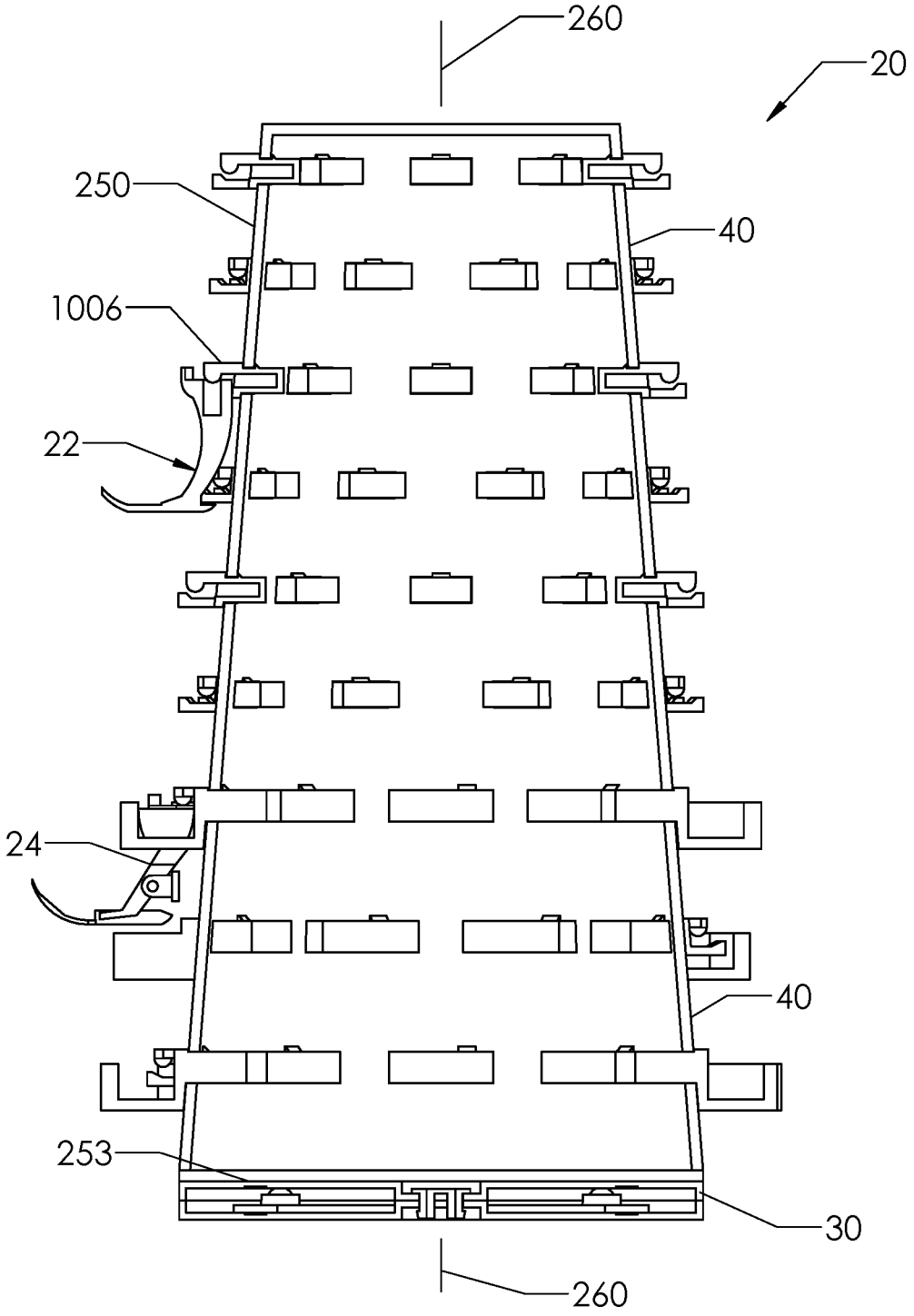
FIG. 2 is a cross-sectional schematic of the storage device of FIG. 1.
Figure 3:
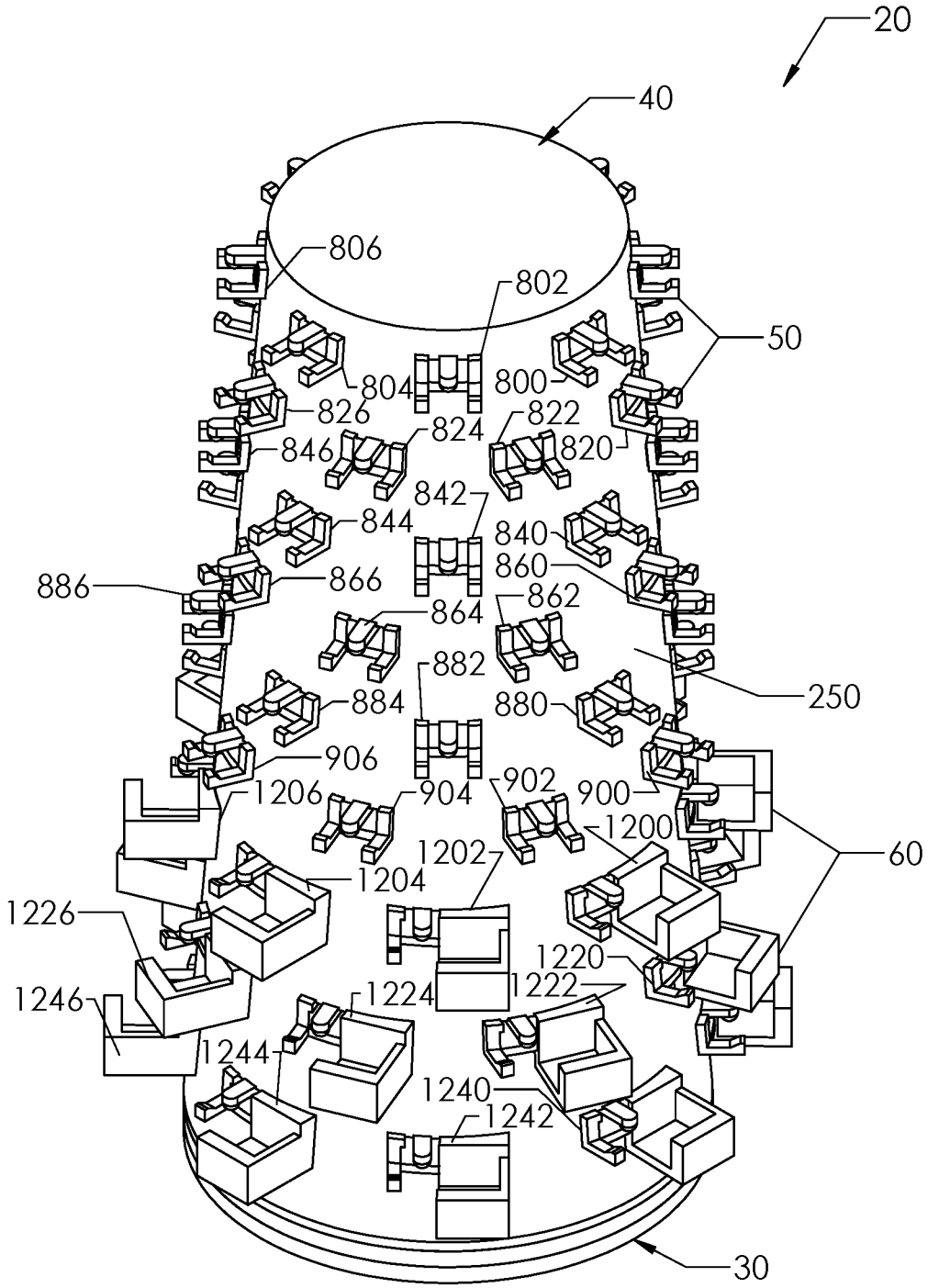
FIG. 3 is another schematic of the storage device of FIG. 1 with a tower member at a first rotational position without the first and second sewing machine presser feet thereon.
Figure 4:
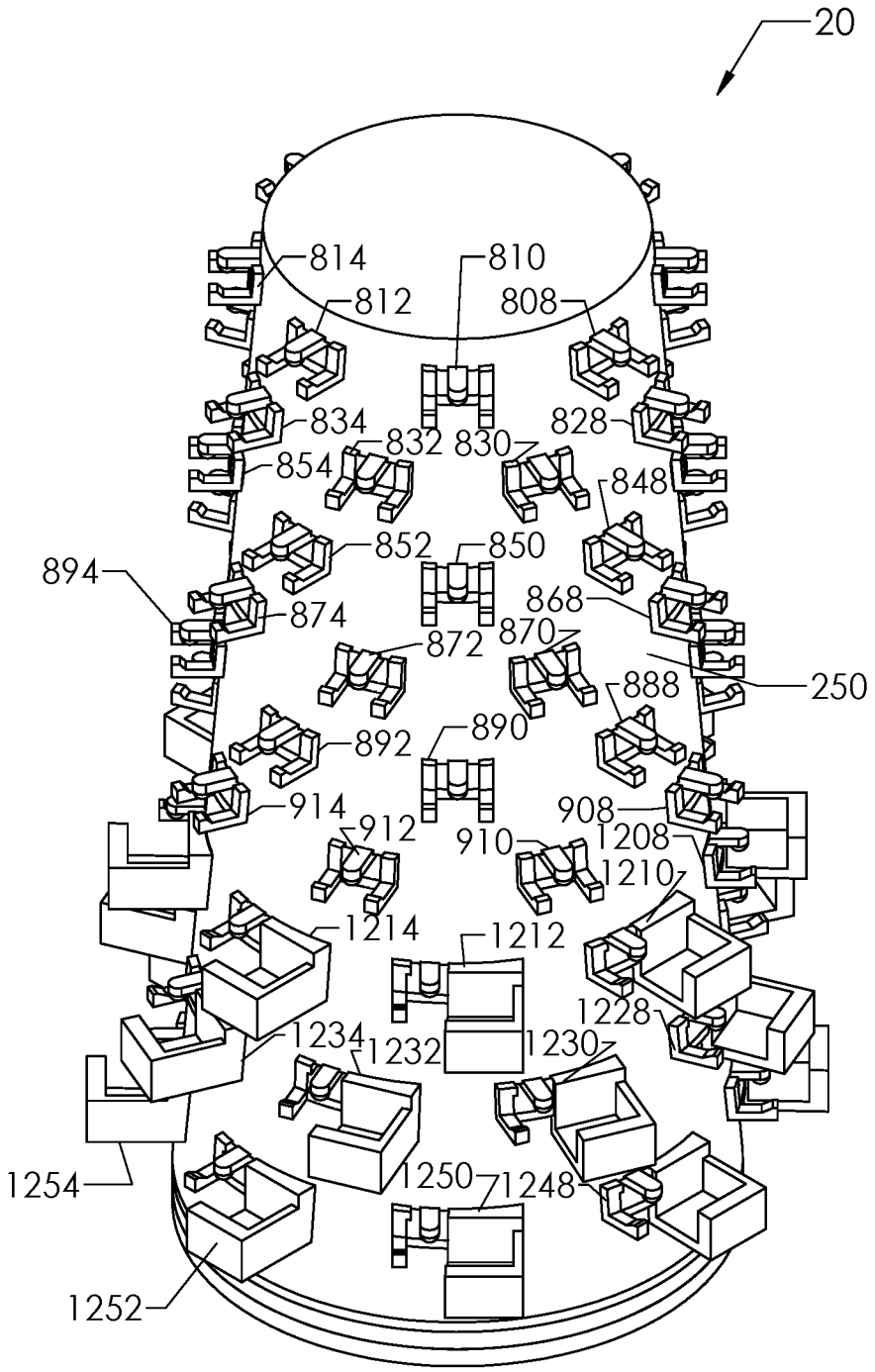
FIG. 4 is another schematic of the storage device of FIG. 1 with the tower member at a second rotational position.

Referring to FIGS. 1-21, a storage device 20 for holding a plurality of sewing machine presser feet thereon in accordance with an exemplary embodiment is provided. For example, the storage device 24 removably holds the sewing machine presser feet 22, 24 thereon.

The storage device 20 includes a base member 30, a tower member 40, a first plurality of hangers 50, and a second plurality of hangers 60. An advantage of the storage device 20 is that the storage device 20 allows the user to easily store a plurality of sewing machine presser feet thereon and to access any one of the plurality of sewing machine presser feet by merely rotating the tower member 40 relative to the base member 30. Further, the storage device 20 allows the user to easily retrieve one of the plurality of sewing machine presser feet utilizing external hangers on the tower member 40, without having to access an interior of a box by opening a lid of the box.

Figure 5:
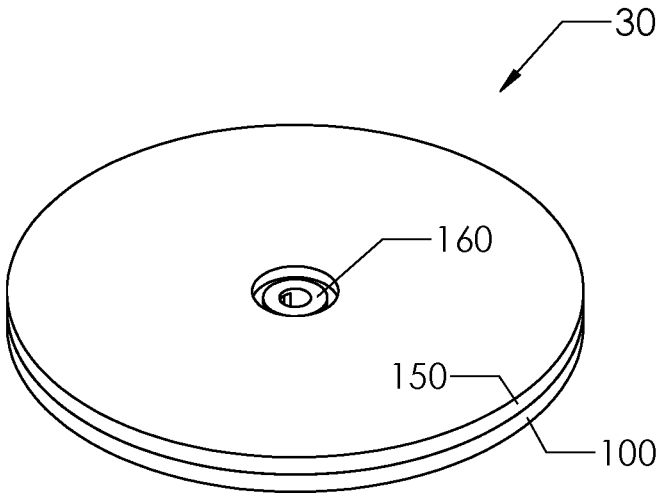
FIG. 5 is a schematic of a base member utilized in the storage device of FIG. 1.
Figure 6:
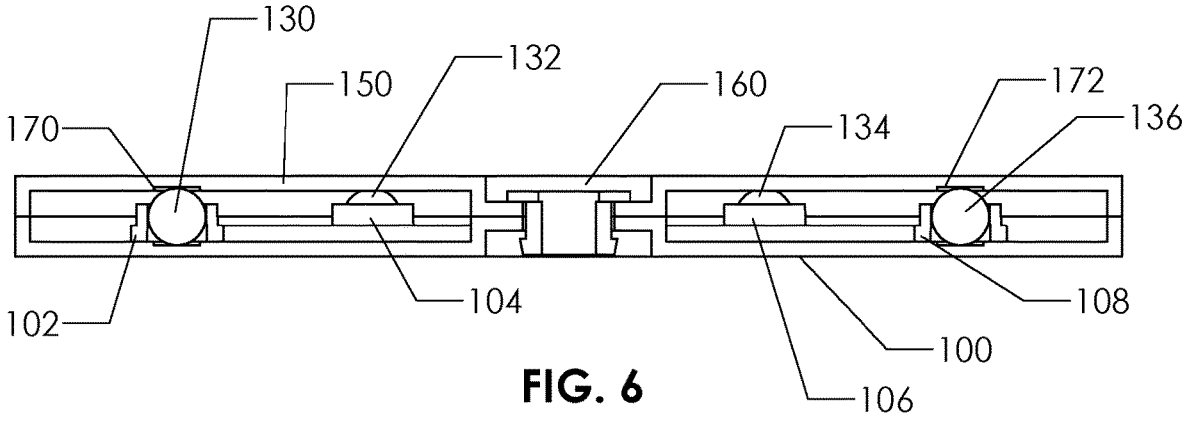
FIG. 6 is a cross-sectional schematic of the base member of FIG. 5.

Referring to FIGS. 1, 5 and 6, the base member 20 is provided to hold the tower member 40 thereon such that the tower member 40 is rotatably coupled to the base member 20. The base member 20 includes a base plate 100, ball bearing holders 102, 104, 106, 108, ball bearings 130, 132, 134, 136, a top plate 150, and a retaining clip 160. The ball bearing holders 102, 104, 106, 108 are coupled to a top surface of the base plate 100 and are configured to hold the ball bearings 130, 132, 134, 136, respectively, therein. The top plate 150 is rotatably disposed on the ball bearings 130, 132, 134, 136 and is rotatably coupled to the base plate 100 utilizing a retaining clip 160. During operation, the top plate 150 is rotated relative to the stationary base plate 100. The top plate 150 is coupled to a bottom wall 202 (shown in FIG. 9) of the tower member 40 utilizing an adhesive for example. In an exemplary embodiment, the base plate 100, the ball bearing holders 102, 104, 106, 108, the top plate 150 and the retaining clip 160 are constructed of plastic. Further, the ball bearings 130, 132, 134, 136 are constructed of steel.

Referring to FIGS. 1 and 3-9, the tower member 40 is provided to be rotatably disposed on the base member 30. The tower member 40 is further provided to hold the first and second plurality of hangers 50, 60 thereon. The tower 40 is centered along a longitudinal axis 260 (shown in FIG. 9) and extends along the longitudinal axis 260. The tower member 40 includes an outer side wall 200 (shown in FIG. 9), a bottom wall 202 (shown in FIG. 9), and a top wall 204 (shown in FIG. 9). The outer side wall 202 is coupled to and extends between the bottom wall 202 and the top wall 204. In an exemplary embodiment, the tower member 40 is a truncated conical tower member, and the outer side wall 200, the bottom wall 202, and the top wall 204 are each constructed of plastic.

Figure 7:
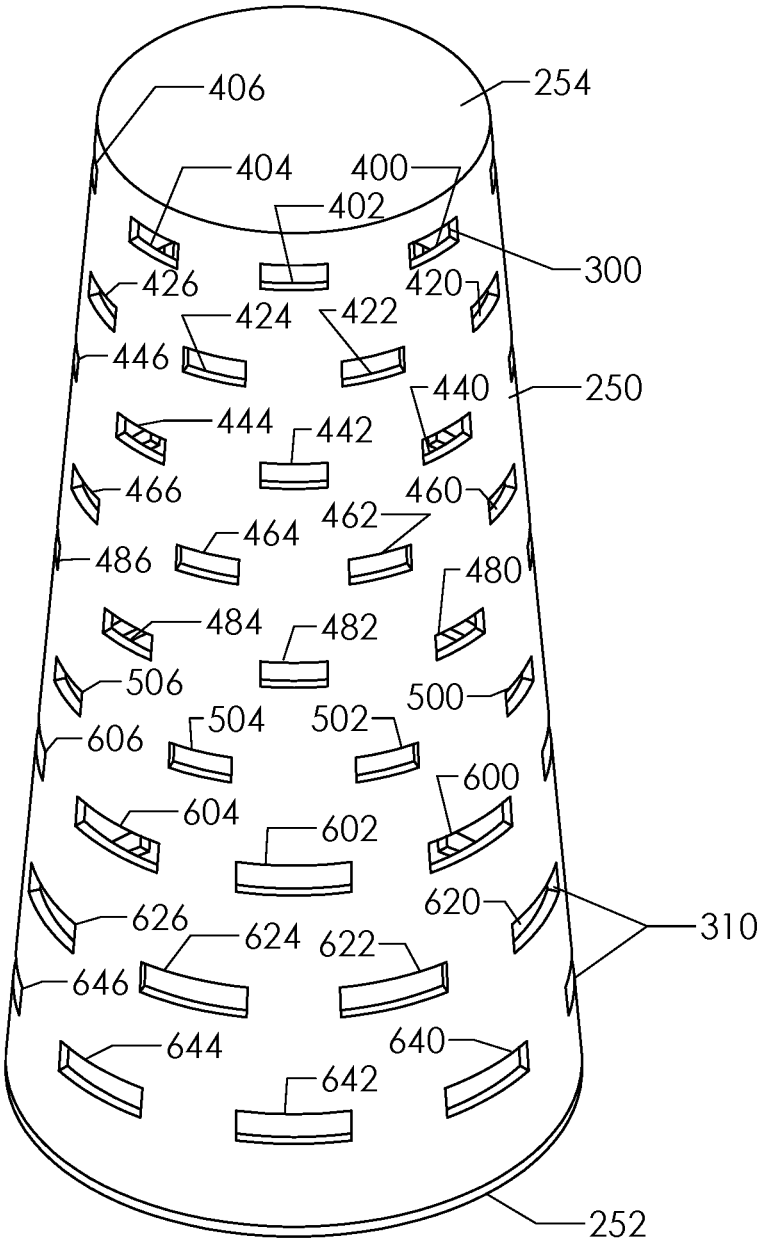
FIG. 7 is a schematic of a tower member utilized in the storage device of FIG. 1.
Figure 8:
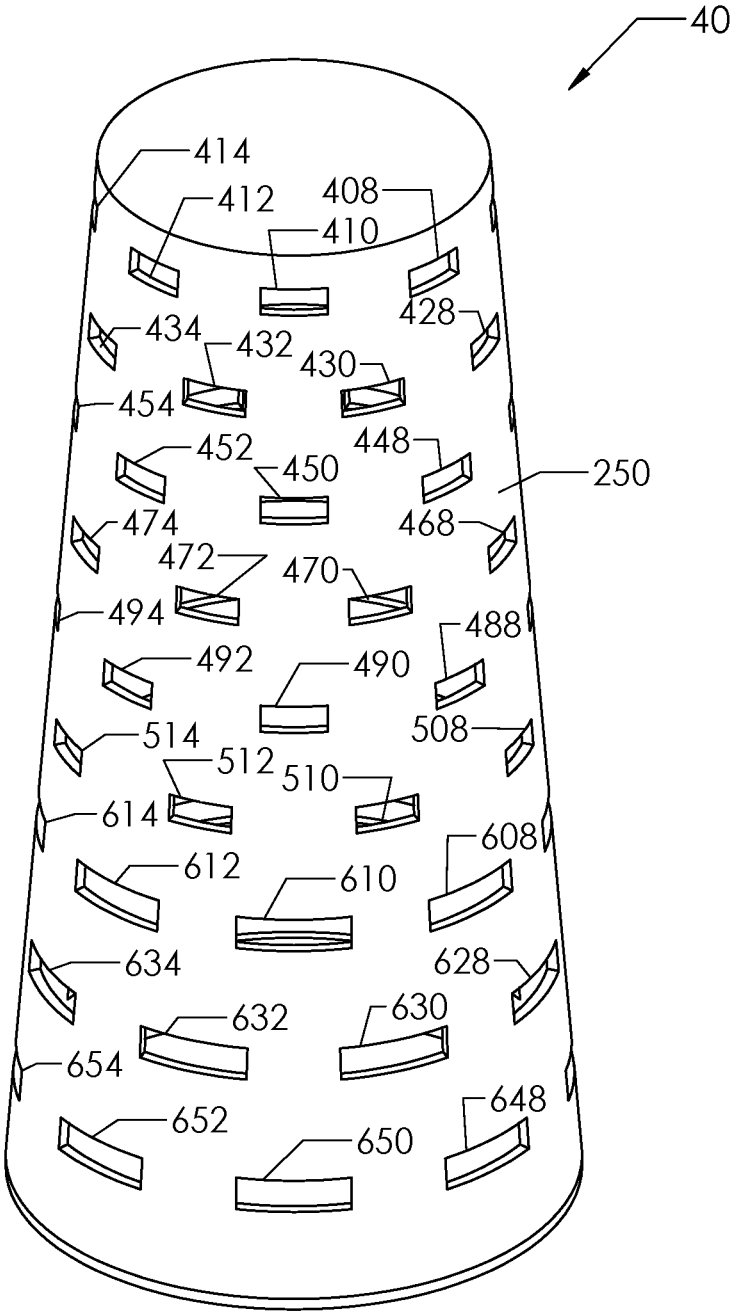
FIG. 8 is another schematic of the tower member of FIG. 7.
Figure 9:
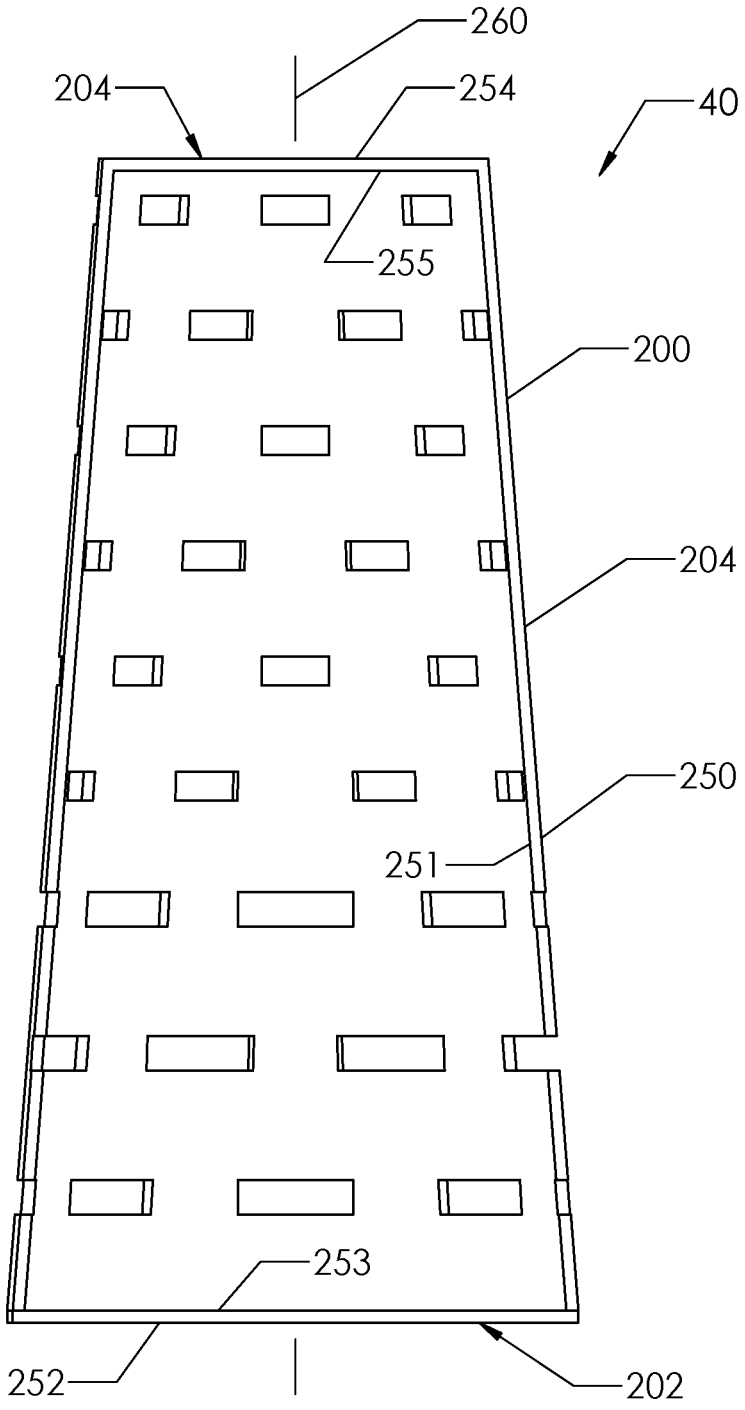
FIG. 9 is a cross-sectional schematic of the tower member of FIG. 7.

Referring to FIGS. 7-9, the outer side wall 200 includes an outer side surface 250 and an inner side surface 251. The outer sidewall 200 further includes a first plurality of apertures 300 and a second plurality of apertures 310 extending therethrough.

The first plurality of apertures 300 include apertures 400, 402, 404, 406, 408, 410, 412, 414, 420, 422, 424, 426, 428, 430, 432, 434, 440, 442, 444, 446, 448, 450, 452, 454, 460, 462, 464, 466, 468, 470, 472, 474, 480, 482, 484, 486, 488, 490, 492, 494, 500, 502, 504, 506, 508, 510, 512, 514.

The apertures 400, 402, 404, 406, 408, 410, 412, 414 comprise a first set of apertures that are disposed circumferentially around the outer side surface 250 of the tower member 40 at a first longitudinal location along the longitudinal axis 260.

The apertures 420, 422, 424, 426, 428, 430, 432, 434 comprise a second set of apertures that are disposed circumferentially around the outer side surface 250 of the tower member 40 at a second longitudinal location along the longitudinal axis 260.

The apertures 440, 442, 444, 446, 448, 450, 452, 454 comprise a third set of apertures that are disposed circumferentially around the outer side surface 250 of the tower member 40 at a third longitudinal location along the longitudinal axis 260.

The apertures 460, 462, 464, 466, 468, 470, 472, 474 comprise a fourth set of apertures that are disposed circumferentially around the outer side surface 250 of the tower member 40 at a fourth longitudinal location along the longitudinal axis 260.

The apertures 480, 482, 484, 486, 488, 490, 492, 494 comprise a fifth set of apertures that are disposed circumferentially around the outer side surface 250 of the tower member 40 at a fifth longitudinal location along the longitudinal axis 260.

The apertures 500, 502, 504, 506, 508, 510, 512, 514 comprise a sixth set of apertures that are disposed circumferentially around the outer side surface 250 of the tower member 40 at a sixth longitudinal location along the longitudinal axis 260.

The second plurality of apertures 310 are disposed longitudinally below the first plurality of apertures 300. The second plurality of apertures 310 include apertures 600, 602, 604, 606, 608, 610, 612, 614, 620, 622, 624, 626, 628, 630, 632, 634, 640, 642, 644, 646, 648, 650, 652, 654.

The apertures 600, 602, 604, 606, 608, 610, 612, 614 comprise a seventh set of apertures that are disposed circumferentially around the outer side surface 250 of the tower member 40 at a seventh longitudinal location along the longitudinal axis 260.

The apertures 620, 622, 624, 626, 628, 630, 632, 634 comprise an eighth set of apertures that are disposed circumferentially around the outer side surface 250 of the tower member 40 at an eighth longitudinal location along the longitudinal axis 260.

The apertures 640, 642, 644, 646, 648, 650, 652, 654 comprise a ninth set of apertures that are disposed circumferentially around the outer side surface 250 of the tower member 40 at a ninth longitudinal location along the longitudinal axis 260.

Referring to FIGS. 3, 4, 7 and 8, the first plurality of hangers 50 are removably coupled to the tower member 40. The first plurality of hangers 50 are provided to hold a plurality of sewing machine presser feet thereon. The first plurality of hangers 50 include hangers 800, 802, 804, 806, 808, 810, 812, 814, 820, 822, 824, 826, 828, 830, 832, 834, 840, 842, 844, 846, 848, 850, 852, 854, 860, 862, 864, 866, 868, 870, 872, 874, 880, 882, 884, 886, 888, 890, 892, 894, 900, 902, 904, 906, 908, 910, 912, 914.

The hangers 800, 802, 804, 806, 808, 810, 812, 814 comprise a first set of hangers that are disposed circumferentially around the outer side surface 250 of the tower member 40 at a first longitudinal location along the longitudinal axis 260. The hangers 800, 802, 804, 806, 808, 810, 812, 814 have respective rear coupling members that extend into the apertures 400, 402, 404, 406, 408, 410, 412, 414, respectively for removably coupling the hangers 800-814 to the tower member 40.

The hangers 820, 822, 824, 826, 828, 830, 832, 834 comprise a second set of hangers that are disposed circumferentially around the outer side surface 250 of the tower member 40 at a second longitudinal location along the longitudinal axis 260. The hangers 820, 822, 824, 826, 828, 830, 832, 834 have respective rear coupling members that extend into the apertures 420, 422, 424, 426, 428, 430, 432, 434, respectively for removably coupling the hangers 820-834 to the tower member 40. Each of the hangers 820-834 are offset circumferentially about the longitudinal axis 260 from each of the hangers 800-814.

The hangers 840, 842, 844, 846, 848, 850, 852, 854 comprise a third set of hangers that are disposed circumferentially around the outer side surface 250 of the tower member 40 at a third longitudinal location along the longitudinal axis 260. The hangers 840, 842, 844, 846, 848, 850, 852, 854 have respective rear coupling members that extend into the apertures 440, 442, 444, 446, 448, 450, 452, 454, respectively for removably coupling the hangers 840-854 to the tower member 40. Each of the hangers 840-854 are offset circumferentially about the longitudinal axis 260 from each of the hangers 820-834.

The hangers 860, 862, 864, 866, 868, 870, 872, 874 comprise a fourth set of hangers that are disposed circumferentially around the outer side surface 250 of the tower member 40 at a fourth longitudinal location along the longitudinal axis 260. The hangers 860, 862, 864, 866, 868, 870, 872, 874 have respective rear coupling members that extend into the apertures 460, 462, 464, 466, 468, 470, 472, 474, respectively for removably coupling the hangers 860-874 to the tower member 40. Each of the hangers 860-874 are offset circumferentially about the longitudinal axis 260 from each of the hangers 840-854.

The hangers 880, 882, 884, 886, 888, 890, 892, 894 comprise a fifth set of apertures that are disposed circumferentially around the outer side surface 250 of the tower member 40 at a fifth longitudinal location along the longitudinal axis 260. The hangers 880, 882, 884, 886, 888, 890, 892, 894 have respective rear coupling members that extend into the apertures 480, 482, 484, 486, 488, 490, 492, 494, respectively for removably coupling the hangers 880-894 to the tower member 40. Each of the hangers 880-894 are offset circumferentially about the longitudinal axis 260 from each of the hangers 860-874.

The hangers 900, 902, 904, 906, 908, 910, 912, 914 comprise a sixth set of apertures that are disposed circumferentially around the outer side surface 250 of the tower member 40 at a sixth longitudinal location along the longitudinal axis 260. The hangers 900, 902, 904, 906, 908, 910, 912, 914 have respective rear coupling members that extend into the apertures 500, 502, 504, 506, 508, 510, 512, 514, respectively for removably coupling the hangers 900-914 to the tower member 40. Each of the hangers 900-914 are offset circumferentially about the longitudinal axis 260 from each of the hangers 880-894.

Referring to FIGS. 1 and 10-15, the structure of each of the hangers in the first plurality of hangers 50 are identical to one another. For purposes of simplicity, only the structure of the hanger 844 of the first plurality of hangers 50 will be described in greater detail below.

The hanger 844 includes a first extension arm 1000, a second extension arm 1002, a mounting plate 1004, a tab member 1006, and a rear coupling member 1008. The first and second extension arms 1000, 1002 and the tab member 1006 are configured to hold a sewing machine presser feet 22 (shown in FIG. 1) thereon.

The first and second extension arms 1000, 1002 and the tab member 1006 are coupled to the mounting plate 1004 and extend in a first direction relative to the mounting plate 1004. The tab member 1006 is further disposed between and above the first and second extension arms 1000, 1002. Each of the first and second extension arms 1000, 1002 and the tab member 1006 extend outwardly from the outer side surface 250 (shown in FIG. 2) substantially parallel to a bottom surface 253 (shown in FIG. 2) of the tower member 40. Also, the first and second extension arms 1000, 1002 have a length greater than a length of the tab member 1006 in a direction substantially parallel to the bottom surface 253 of the tower member 40. The tab member 1006 has a downwardly extending hump 1020 (shown in FIG. 14) therein that is sized and shaped to be received in an aperture of 1528 (shown in FIG. 24) of the sewing machine presser feet 22.

The rear coupling member 1008 is coupled to the mounting plate 1004 and extends in an opposite direction of the first and second extension arms 1000, 1002 and the tab member 1006. The rear coupling member 1008 includes an extension member 1030, an attachment tab 1032, and slots 1034, 1035. The extension member 1030 is directly coupled to the mounting plate 1004 and has a flat top surface 1040 (shown in FIG. 12) and a flat bottom surface 1042. The slots 1034, 1035 extend into the extension member 1030 and form a flexible arm 1044 (shown in FIGS. 10 and 11) in the extension member 1030. The attachment tab 1032 (shown in FIG. 12) extends upwardly from the flat top surface 1040 of the extension member 1030.

Figure 24:
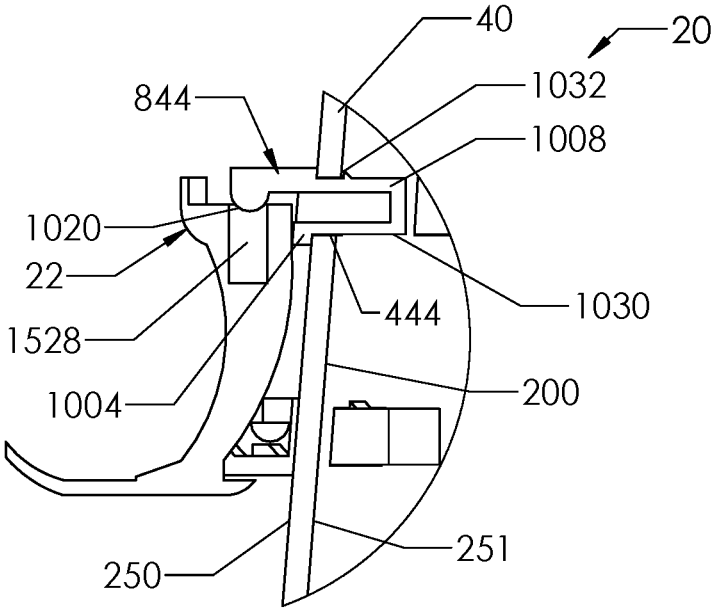
FIG. 24 is a cross-sectional schematic of a portion of the storage device and first sewing machine presser feet of FIG. 1.

Referring to FIG. 24, a brief explanation of a method of attaching the hanger 844 to the tower member 40 will now be provided. In particular, the extension member 1030 of the rear coupling member 1008 is disposed through the aperture 444 (shown in FIG. 7) such that the attachment tab 1032 of the rear coupling member 1008 engages and contacts the inner side surface 251 of the outer side wall 200 of the tower member 40 to hold the mounting plate 1004 (shown in FIG. 10) of the hanger 844 against the outer side surface 250 of the outer side wall 200 of the tower member 40. The hanger 844 is detached from the tower member 40 by supplying a sufficient outwardly extending force from the tower member 40 such that the attachment tab 1032 of the rear coupling member 1008 no longer engages and contacts the inner side surface 251 of the outer side wall 200 of the tower member 40.

Figure 10:
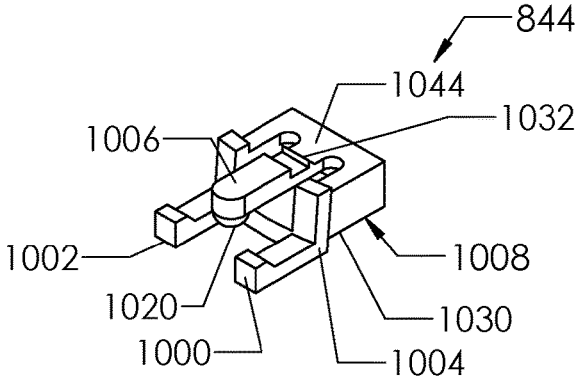
FIG. 10 is a schematic of a first hanger utilized in the storage device of FIG. 1.
Figure 11:
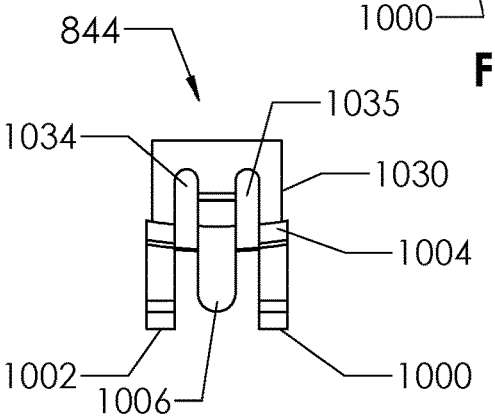
FIG. 11 is a top view of the first hanger of FIG. 10.
Figure 12:
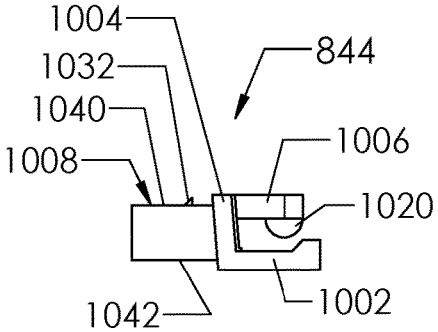
FIG. 12 is a first side view of the first hanger of FIG. 10.
Figure 13:
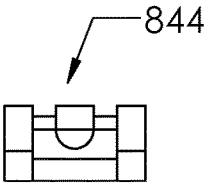
FIG. 13 is a front view of the first hanger of FIG. 10.
Figure 14:
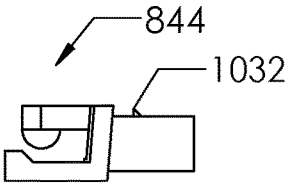
FIG. 14 is a second side view of the first hanger of FIG. 10.
Figure 15:
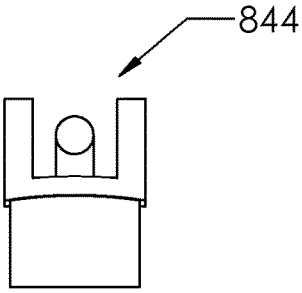
FIG. 15 is a bottom view of the first hangar of FIG. 10.
Figure 22:
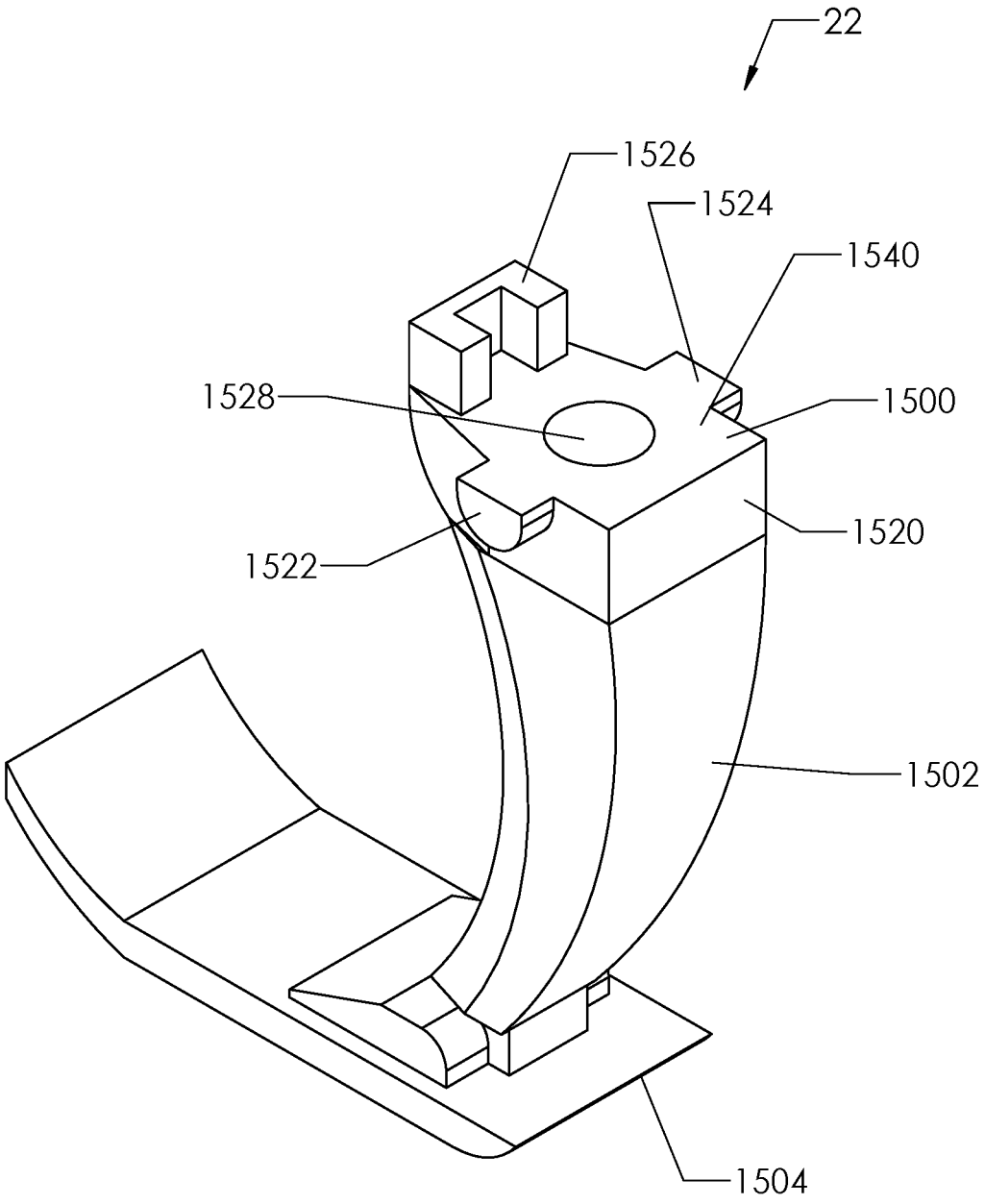
FIG. 22 is an enlarged schematic of the first sewing machine presser feet of FIG. 1.

Referring to FIGS. 10, 22 and 24, a brief explanation of a structure of the sewing machine presser feet 22 will now be provided.

The sewing machine presser feet 22 includes a top end portion 1500, a leg portion 1502, and a foot portion 1504. The top end portion 1500 is coupled to a first end of the leg portion 1502. The foot portion 1504 is coupled to a second end of the leg portion 1502. The top end portion 1500 includes a main body 1520, a first side tab 1522, a second side tab 1524, a C-shaped block 1526. The first side tab 1522 and the second side tab 1524 are coupled to opposite sides of the main body 1520. The C-shaped block 1526 is coupled to a top surface 1540 of the main body 1520. An aperture 1528 extends from the top surface 1540 of the main body 1520 into the main body 1520.

Referring to FIGS. 1, 10, 22, 24, a brief explanation of a method for attaching the sewing machine presser feet 22 to the hanger 844 will now be provided. The first and second side tabs 1522, 1524 (shown in FIG. 22) of the sewing machine presser feet 22 are disposed on the first and second extension arms 1000, 1002 (shown in FIG. 10), respectively of the hanger 844 such that the hump 1020 (shown in FIG. 24) of the tab member 1006 of the hanger 844 is disposed in the aperture 1528 of the sewing machine presser feet 22 to removably hold the sewing machine presser feet 22 on the hanger 844. The sewing machine presser feet 22 is removed from the hanger 844 by rotating the sewing machine presser feet 22 upwardly such that the hump 1020 of the tab member 1006 of the hanger 844 is no longer disposed in the aperture 1528 of the sewing machine presser feet 22.

Referring to FIGS. 3, 4, 7 and 8, the second plurality of hangers 60 are removably coupled to the tower member 40. The second plurality of hangers 60 are provided to hold a plurality of sewing machine presser feet thereon. The second plurality of hangers 60 include hangers 1200, 1202, 1204, 1206, 1208, 1210, 1212, 1214, 1220, 1222, 1224, 1226, 1228, 1230, 1232, 1234, 1240, 1242, 1244, 1246, 1248, 1250, 1252, 1254.

The hangers 1200, 1202, 1204, 1206, 1208, 1210, 1212, 1214 comprise a seventh set of hangers that are disposed circumferentially around the outer side surface 250 of the tower member 40 at a seventh longitudinal location along the longitudinal axis 260. The hangers 1200, 1202, 1204, 1206, 1208, 1210, 1212, 1214 have respective rear coupling members that extend into the apertures 600, 602, 604, 606, 608, 610, 612, 614, respectively for removably coupling the hangers 1200-1214 to the tower member 40.

The hangers 1220, 1222, 1224, 1226, 1228, 1230, 1232, 1234 comprise an eighth set of hangers that are disposed circumferentially around the outer side surface 250 of the tower member 40 at an eighth longitudinal location along the longitudinal axis 260. The hangers 1220, 1222, 1224, 1226, 1228, 1230, 1232, 1234 have respective rear coupling members that extend into the apertures 620, 622, 624, 626, 628, 630, 632, 634, respectively for removably coupling the hangers 1220-1234 to the tower member 40. Each of the hangers 1120-1234 are offset circumferentially about the longitudinal axis 260 from each of the hangers 1200-1214.

The hangers 1240, 1242, 1244, 1246, 1248, 1250, 1252, 1254 comprise a ninth set of hangers that are disposed circumferentially around the outer side surface 250 of the tower member 40 at a ninth longitudinal location along the longitudinal axis 260. The hangers 1240, 1242, 1244, 1246, 1248, 1250, 1252, 1254 have respective rear coupling members that extend into the apertures 640, 642, 644, 646, 648, 650, 652, 654, respectively for removably coupling the hangers 1240-1254 to the tower member 40. Each of the hangers 1240-1254 are offset circumferentially about the longitudinal axis 260 from each of the hangers 1220-1234.

Referring to FIGS. 1 and 16-21, the structure of each of the hangers in the second plurality of hangers 60 are identical to one another. For purposes of simplicity, only the structure of the hanger 1204 (shown in FIG. 1) of the second plurality of hangers 60 will be described in greater detail below.

The hanger 1204 includes a first extension arm 1400, a second extension arm 1402, a mounting plate 1404, a tab member 1406, and a rear coupling member 1408. The first and second extension arms 1400, 1402 and the tab member 1406 are configured to hold a sewing machine presser feet 24 (shown in FIG. 1) thereon.

The first and second extension arms 1400, 1402 and the tab member 1406 are coupled to the mounting plate 1404 and extend in a first direction relative to the mounting plate 1404. The tab member 1406 is further disposed between and above the first and second extension arms 1400, 1402. Each of the first and second extension arms 1400, 1402 and the tab member 1406 extend outwardly from the outer side surface 250 (shown in FIG. 2) substantially parallel to a bottom surface 253 (shown in FIG. 2) of the tower member 40. Also, the first and second extension arms 1400, 1402 have a length greater than a length of the tab member 1406 in a direction substantially parallel to the bottom surface 253 of the tower member 40. The tab member 1406 has a downwardly extending hump 1420 therein that is sized and shaped to be received in an aperture of 1528 (shown in FIG. 25) of the sewing machine presser feet 24.

The rear coupling member 1408 is coupled to the mounting plate 1404 and extends in an opposite direction of the first and second extension arms 1400, 1402 and the tab member 1406. The rear coupling member 1408 includes an extension member 1430, an attachment tab 1432, and slots 1434, 1435. The extension member 1430 is directly coupled to the mounting plate 1404 and has a flat top surface 1440 (shown in FIG. 18) and a flat bottom surface 1442. The slots 1434, 1435 extend into the extension member 1430 and form a flexible arm 1444 (shown in FIGS. 16 and 17) in the extension member 1430. The attachment tab 1432 (shown in FIG. 18) extends upwardly from the flat top surface 1440 of the extension member 1430.

Figure 25:
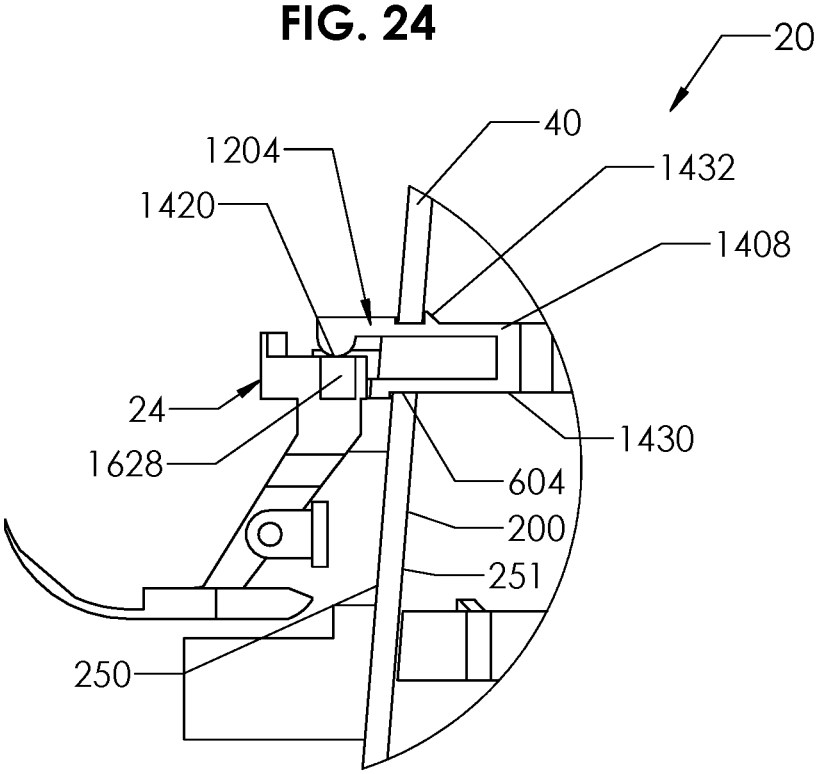
FIG. 25 is a cross-sectional schematic of a portion of the storage device and second sewing machine presser feet of FIG. 1.

Referring to FIG. 25, a brief explanation of a method of attaching the hanger 1204 to the tower member 40 will now be provided. In particular, the extension member 1430 of the rear coupling member 1408 is disposed through the aperture 604 (shown in FIG. 7) such that the attachment tab 1432 of the rear coupling member 1408 engages and contacts the inner side surface 251 of the outer side wall 200 of the tower member 40 to hold the mounting plate 1404 (shown in FIG. 16) of the hanger 1204 against the outer side surface 250 of the outer side wall 200 of the tower member 40. The hanger 1204 is detached from the tower member 40 by supplying a sufficient outwardly extending force from the tower member 40 such that the attachment tab 1432 of the rear coupling member 1408 no longer engages and contacts the inner side surface 251 of the outer side wall 200 of the tower member 40.

Figure 16:
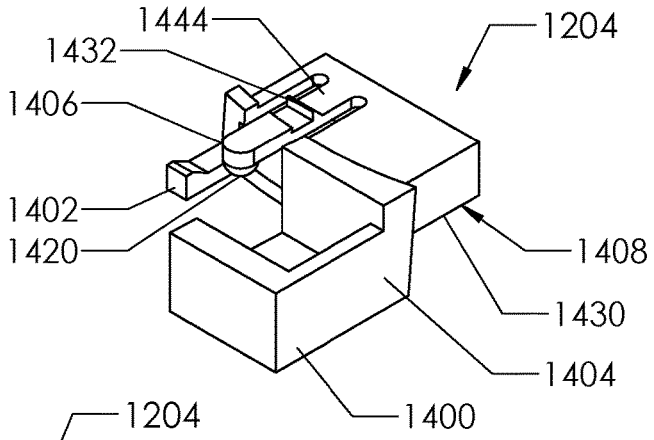
FIG. 16 is a schematic of a second hanger utilized in the storage device of FIG. 1.
Figure 17:
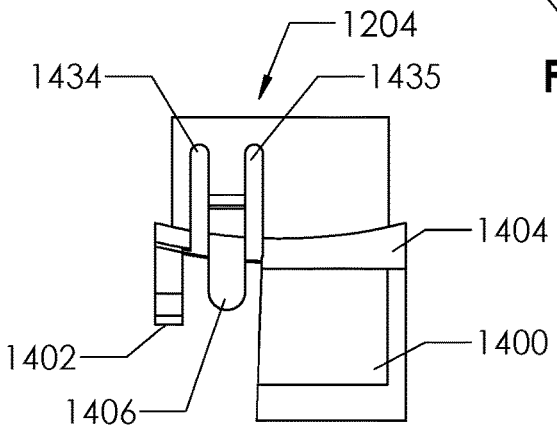
FIG. 17 is a top view of the second hanger of FIG. 16.
Figure 18:
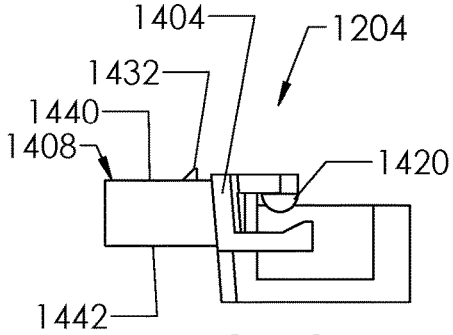
FIG. 18 is a first side view of the second hanger of FIG. 16.
Figure 19:
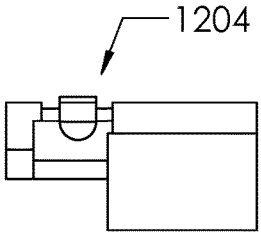
FIG. 19 is a front view of the second hanger of FIG. 16.
Figure 20:
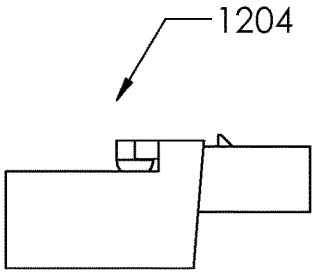
FIG. 20 is a second side view of the second hanger of FIG. 16.
Figure 21:
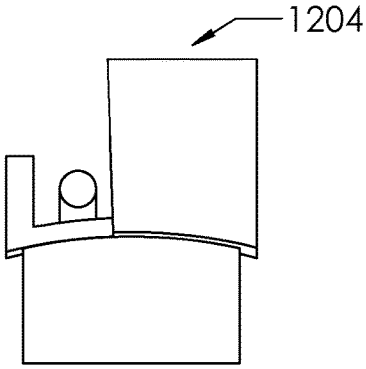
FIG. 21 is a bottom view of the second hangar of FIG. 16.
Figure 23:
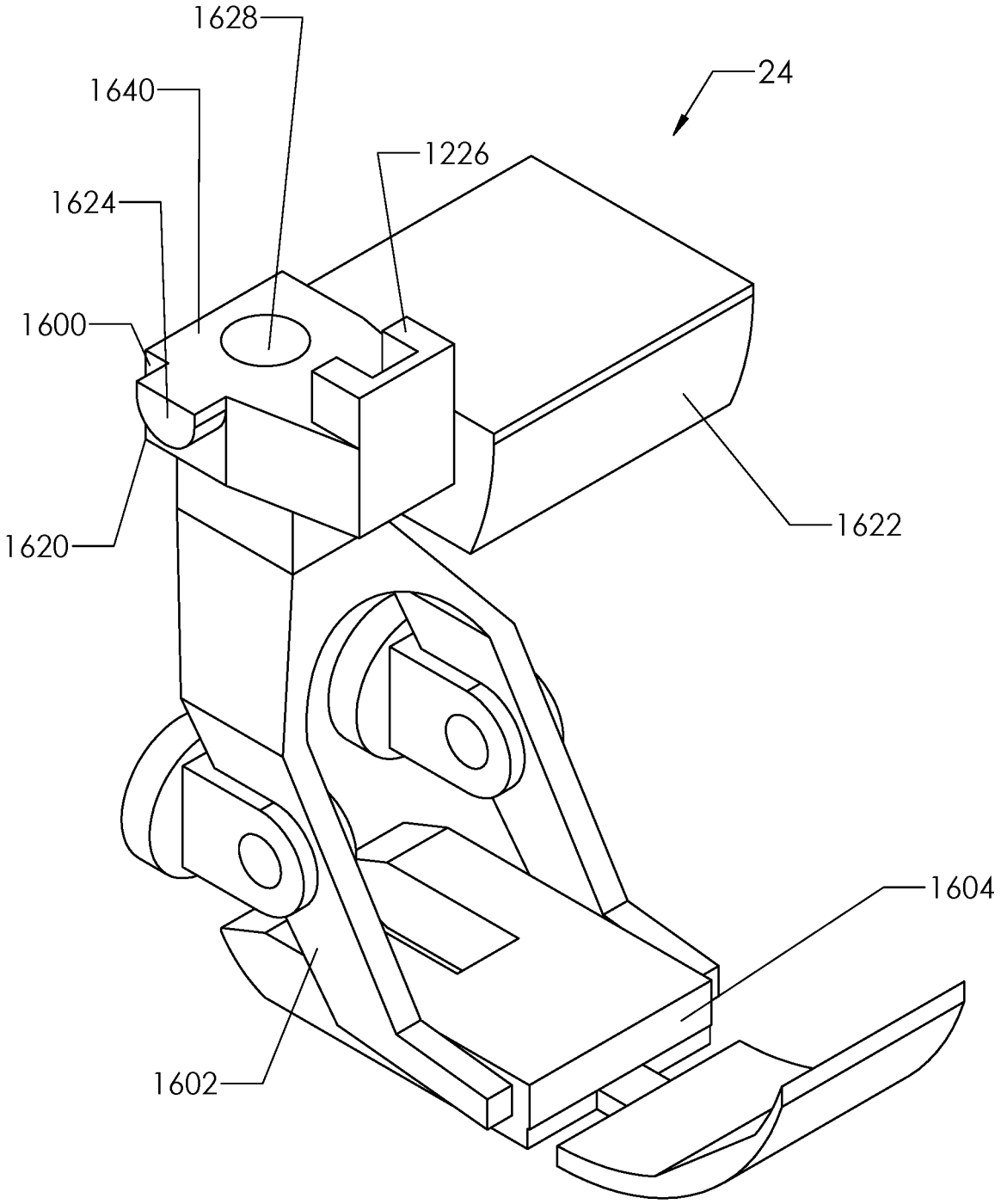
FIG. 23 is an enlarged schematic of the second sewing machine presser feet of FIG. 1.

Referring to FIGS. 16, 23 and 25, a brief explanation of a structure of the sewing machine presser feet 24 will now be provided.

The sewing machine presser feet 24 includes a top end portion 1600, a leg portion 1602, and a foot portion 1604. The top end portion 1600 is coupled to a first end of the leg portion 1602. The foot portion 1604 is coupled to a second end of the leg portion 1602. The top end portion 1600 includes a main body 1620, a first side tab 1622, a second side tab 1624, a C-shaped block 1626. The first side tab 1622 and the second side tab 1624 are coupled to opposite sides of the main body 1620. The C-shaped block 1626 is coupled to a top surface 1640 of the main body 1620. An aperture 1628 extends from the top surface 1640 of the main body 1620 into the main body 1620.

Referring to FIGS. 1, 16, 23, 25, a brief explanation of a method for attaching the sewing machine presser feet 24 to the hanger 1204 will now be provided. The first and second side tabs 1622, 1624 (shown in FIG. 23) of the sewing machine presser feet 24 are disposed on the first and second extension arms 1400, 1402 (shown in FIG. 16), respectively of the hanger 1204 such that the hump 1420 (shown in FIG. 18) of the tab member 1406 of the hanger 1204 is disposed in the aperture 1628 of the sewing machine presser feet 24 to removably hold the sewing machine presser feet 24 on the hanger 1204. The sewing machine presser feet 24 is removed from the hanger 1204 by rotating the sewing machine presser feet 24 upwardly such that the hump 1620 of the tab member 1406 of the hanger 1204 is no longer disposed in the aperture 1628 of the sewing machine presser feet 24.

The storage device 20 described herein provides a substantial advantage over other devices utilized to store sewing machine presser feet. In particular, the storage device 20 allows a user to easily store a plurality of sewing machine presser feet thereon and to access any one of the plurality of sewing machine presser feet by merely rotating the tower member 40 relative to the base member 30. Further, the storage device 20 allows the user to easily retrieve one of the plurality of sewing machine presser feet utilizing external hangers on the tower member 40, without having to access an interior of a box by opening a lid of the box.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. A storage device for sewing machine presser feet, comprising:

a base member; and a tower member rotatably coupled to the base member, the tower member being centered about a longitudinal axis and extending along the longitudinal axis, the tower member having an outer side surface with a first plurality of hangers disposed thereon, the first plurality of hangers including a first hanger, the first hanger having first and second extension arms, a tab member, and a mounting plate; the first and second extension arms and the tab member of the first hanger being coupled to and extending outwardly from the mounting plate of the first hanger in a first direction; the tab member of the first hanger being disposed between and above the first and second extension arms of the first hanger, the tab member of the first hanger having a downwardly extending hump, a gap being formed between the first extension arm and the tab member of the first hanger for receiving a portion of a first sewing machine presser feet within the gap, such that first and second side tabs of the first sewing machine presser feet are disposed on the first and second extension arms, respectively, and the downwardly extending hump is received in an aperture of the first sewing machine presser feet.

2. The storage device of claim 1, wherein:

each of the first and second extension arms and the tab member of the first hanger extending outwardly from the outer side surface substantially parallel to a bottom surface of the tower member.

3. The storage device of claim 1, wherein:

each of the first and second extension arms of the first hanger having a length greater than a length of the tab member of the first hanger in the first direction substantially parallel to a bottom surface of the tower member.

4. The storage device of claim 1, wherein:

the first plurality of hangers being disposed circumferentially around the outer side surface of the tower member and being spaced apart from one another.

5. The storage device of claim 4, wherein:

the first plurality of hangers comprising first and second sets of hangers;

the first set of hangers being disposed at a first longitudinal location relative to a bottom surface of the tower member;

the second set of hangers being disposed at a second longitudinal location relative to the bottom surface of the tower member; the second longitudinal location being below the first longitudinal location; and each hanger of the second set of hangers being offset circumferentially about the longitudinal axis from each hanger of the first set of hangers.

6. The storage device of claim 1, wherein:

each hanger of the first plurality of hangers is removably coupled to the tower member.

7. The storage device of claim 1, wherein:

the tower member having a second plurality of hangers disposed thereon that are disposed longitudinally below the first plurality of hangers, the second plurality of hangers including a second hanger, the second hanger having first and second extension arms and a tab member configured to hold a second sewing machine presser feet thereon, the tab member of the second hanger being disposed between and above the first and second extension arms of the second hanger.

8. The storage device of claim 7, wherein:

each of the first and second extension arms and the tab member of the second hanger extending outwardly from the outer side surface substantially parallel to a bottom surface of the tower member.

9. The storage device of claim 7, wherein:

each of the first and second extension arms of the second hanger having a length greater than a length of each tab member of the second hanger in a direction substantially parallel to a bottom surface of the tower member.

10. The storage device of claim 7, wherein:

the tab member of the second hanger having a downwardly extending hump therein.

11. The storage device of claim 7, wherein:

the second plurality of hangers being disposed circumferentially around the outer side surface of the tower member and spaced apart from one another.

12. The storage device of claim 11, wherein:

the second plurality of hangers comprising first and second sets of hangers;

the first set of hangers being disposed at a first longitudinal location relative to a bottom surface of the tower member;

the second set of hangers being disposed at a second longitudinal location relative to the bottom surface of the tower member; the second longitudinal location being below the first longitudinal location; and each hanger of the second set of hangers being offset circumferentially about the longitudinal axis from each hanger of the first set of hangers.

13. The storage device of claim 7, wherein:

each hanger of the second plurality of hangers is removably coupled to the tower member.

14. The storage device of claim 1, wherein:

the tower member being a truncated conical tower member.

15. The storage device of claim 1, wherein:

the mounting plate being disposed against the outer side surface of the tower member; and the first hanger further having a rear coupling member that is coupled to the mounting plate thereof and extending in a second direction opposite to the first direction, the rear coupling member having an extension portion and an attachment tab coupled to the extension portion, the extension portion being received in an aperture of the tower member such that the attachment tab engages and contacts an inner side surface of an outer side wall of the tower member to hold the mounting plate of the first hanger against the outer side surface of the outer side wall of the tower member.

16. The storage device of claim 1, wherein:

the downwardly extending hump being disposed on an end portion of the tab member that is distal from the mounting plate.

17. A storage device, comprising:

a base member; and a tower member rotatably coupled to the base member, the tower member being centered about a longitudinal axis and extending along the longitudinal axis, the tower member having an outer side surface and a first hanger disposed thereon, the first hanger having first and second extension arms and a tab member, the first and second extension arms and the tab member extending outwardly from the outer side surface in a first direction; the tab member being disposed between and above the first and second extension arms, each of the first and second extension arms having a length greater than a length of the tab member in the first direction, the tab member having a downwardly extending hump, a gap being formed between the first extension arm and the tab member for receiving a portion of a first sewing machine presser feet within the gap, such that first and second side tabs of the first sewing machine presser feet are disposed on the first and second extension arms, respectively, and the downwardly extending hump is received in an aperture of the first sewing machine presser feet.

18. The storage device of claim 17, wherein:

the first hanger further having a mounting plate and a rear coupling member; the first and second extension arms and the tab member of the first hanger being coupled to and extending outwardly from the mounting plate in the first direction, the rear coupling member being coupled to the mounting plate and extending in a second direction opposite to the first direction, the rear coupling member having an extension portion and an attachment tab coupled to the extension portion, the extension portion being received in an aperture of the tower member such that the attachment tab engages and contacts an inner side surface of an outer side wall of the tower member to hold the mounting plate of the first hanger against the outer side surface of the outer side wall of the tower member.

19. The storage device of claim 18, wherein:

the downwardly extending hump being disposed on an end portion of the tab member that is distal from the mounting plate.

20. The storage device of claim 17, wherein:

the tower member being a truncated conical tower member having a flat top wall, a flat bottom wall, and an outer side wall; the flat top wall and the flat bottom wall being parallel to one another; the outer side wall being coupled to and extending between the flat top wall and the flat bottom wall; the outer side wall defining the outer side surface.

* * * * *